United States Patent [19]

Scarpa et al.

[11] Patent Number: 4,578,927

[45] Date of Patent: Apr. 1, 1986

[54] PUSHER HEAD DIVERTER FOR A CARTON LOADER

[75] Inventors: Eric W. Scarpa, Cincinnati; James A. Glazier, Okeana, both of Ohio

[73] Assignee: R. A. Jones & Co. Inc., Covington, Ky.

[21] Appl. No.: 441,251

[22] Filed: Nov. 12, 1982

[51] Int. Cl.[4] ..... B65B 57/02

[52] U.S. Cl. ..... 53/506; 53/67; 53/252; 53/566

[58] Field of Search ..... 53/67, 251, 252, 284, 53/505, 506, 566, 572; 198/372, 456

[56] References Cited

U.S. PATENT DOCUMENTS

| | | | |
|---|---|---|---|
| 2,907,155 | 10/1959 | Engleson | 53/252 |
| 3,821,874 | 7/1974 | Jones | 53/252 |
| 3,879,920 | 4/1975 | Langen | 53/506 |
| 4,028,866 | 6/1977 | Langen | 53/252 |
| 4,250,693 | 2/1981 | Andersson | 53/566 |

*Primary Examiner*—James F. Coan

*Attorney, Agent, or Firm*—Wood, Herron & Evans

[57] ABSTRACT

A barrel loader for a cartoner having a product conveyor and a carton conveyor. A plurality of pusher heads are carried on two spaced endless chains. A cam track between the chains cooperates with cam followers on the heads to cam the heads toward the product conveyor to thrust product into the cartons. A switch on the cam track diverts a pusher head from the cam track upon detecting the absence of a carton with which the pusher head is associated.

4 Claims, 7 Drawing Figures

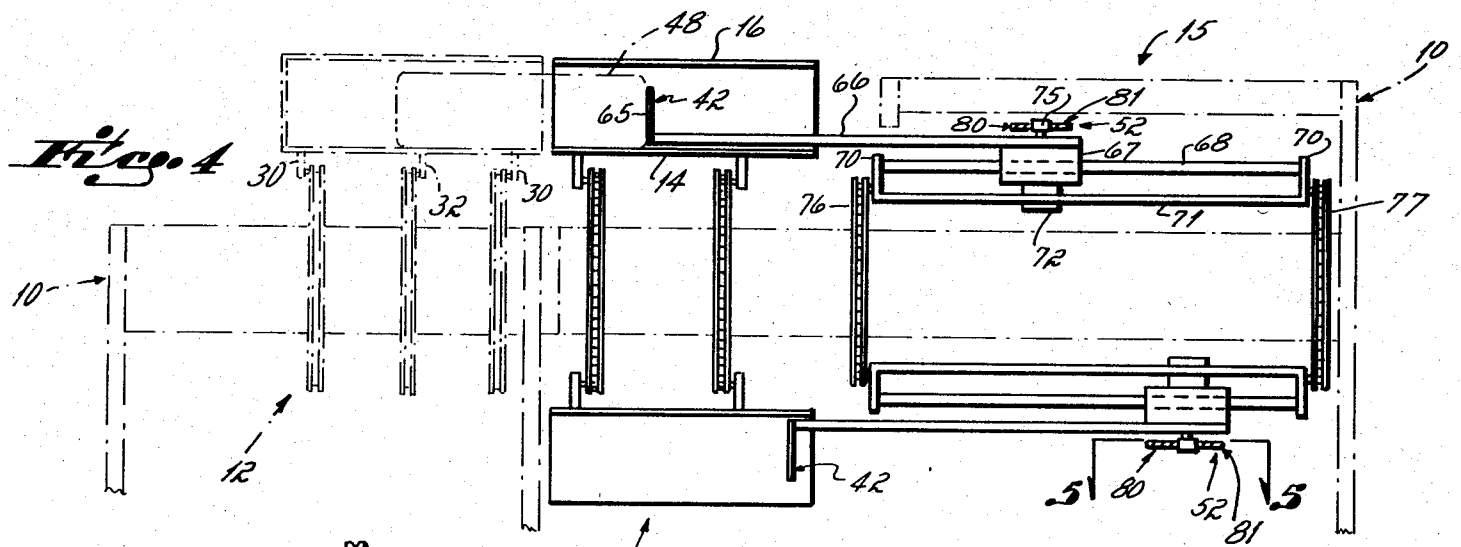
Fig. 4
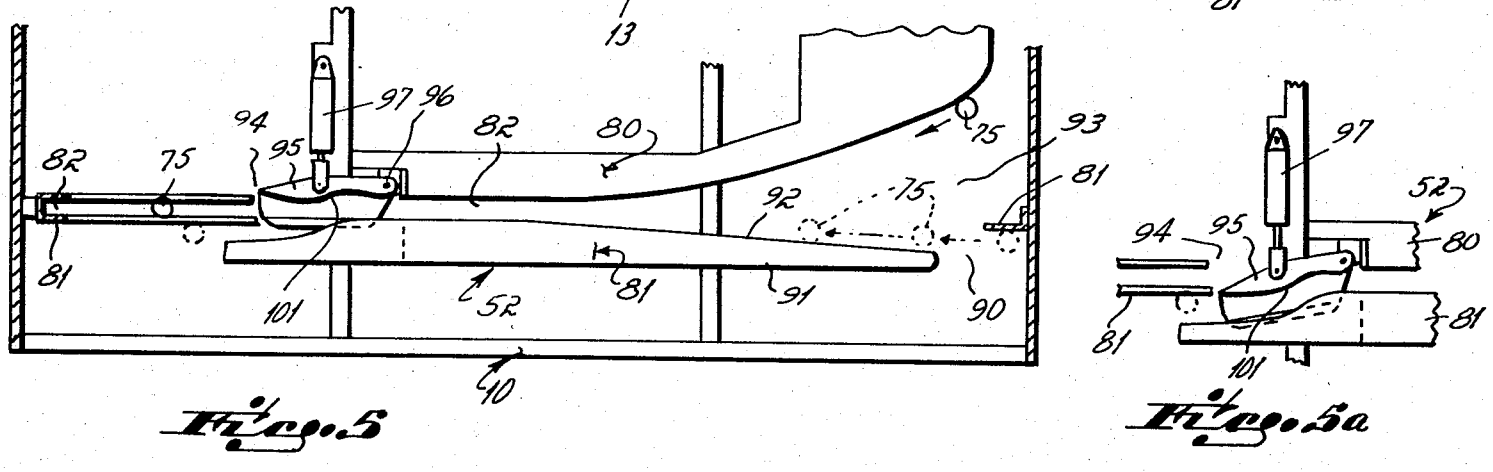
Fig. 5
Fig. 5a

PUSHER HEAD DIVERTER FOR A CARTON LOADER

This invention relates to a cartoner, and more particularly, to a barrel loader for the cartoner.

In general, the cartoner includes a transport conveyor which carries cartons in erected tubular form, a product bucket conveyor running parallel to the transport conveyor, the product bucket conveyor carrying product aligned with the erected cartons and a barrel loader adjacent the product bucket conveyor. The barrel loader includes a pair of chains which carry pusher heads slidably mounted between the chains. A continuous cam track between the chains and generally following the oval path of the chains cooperates with the followers on the pusher heads to cause the pusher heads to move across the product buckets to thrust the product into the individual cartons and to withdraw before the chains carry the pusher heads to the underside of the barrel loader.

It has been known to employ a detector, for example, an electric eye, to determine whether a carton is present between transport lugs of the transport conveyor. If not, it is obviously undesirable to thrust a product from the product bucket onto the transport conveyor where no carton is present. It is preferable to leave the product in the product bucket where it can be lifted out by an operator or dumped into a bin. Therefore, associated with a detector, it has been known to employ, on the upper portion of the cam track, a diverter operable to engage the follower of the pusher head associated with the missing carton location and to prevent the pusher head from being cammed toward the product bucket. The diverter has taken the form of a wedge-shaped element pivoted at the base of the wedge with the apex of the wedge-shaped element facing the oncoming pusher head followers. When a missing carton is detected, the wedge-shaped element is driven into the path of the pusher head follower to cam that follower away from the slot in the cam track which normally cams the pusher head toward the product bucket. At high speeds, for example, 400 cartons per minute, there has been a tendency of that pusher head follower to jam against the apex of the wedge-shaped element and thus to cause a shutdown of the cartoner.

It has been an objective of the present invention to improve upon the diverter described above to avoid the jamming of the follower against the diverter.

This objective of the invention has been attained in part by employing a swinging switch pivoted at its upstream end. The switch, in its shifted position, cams the pusher head follower out of its normal path so that the cam track can block its movement toward the product bucket conveyor. By pivoting the switch at its upstream end, even though the follower is adjacent the switch during its movement to a diverting position, the movement of the switch will simply throw the follower and the associated head out of the normal cam path without any possibility of jamming. Additionally, the diverter is located on the underside of the barrel loader so that it and the mechanism operating it are out of the way of a pivotal portion of an anti-jamming arm on the upper part of the cam track.

BRIEF DESCRIPTION OF THE FIGURES

The objectives and features of this invention will become more readily apparent from the following detailed description taken in conjunction with the accompanying drawings in which:

FIG. 4 is a cross-sectional view taken along lines 4—4 of FIG. 3 showing the barrel loader;

FIG. 5 is a cross-sectional view taken along lines 5—5 of FIG. 4; and FIG. 5*a* is a fragmentary view similar to that of FIG. 5 showing the diverter switch in a shifted position;

GENERAL ORGANIZATION AND OPERATION

Figure 1:
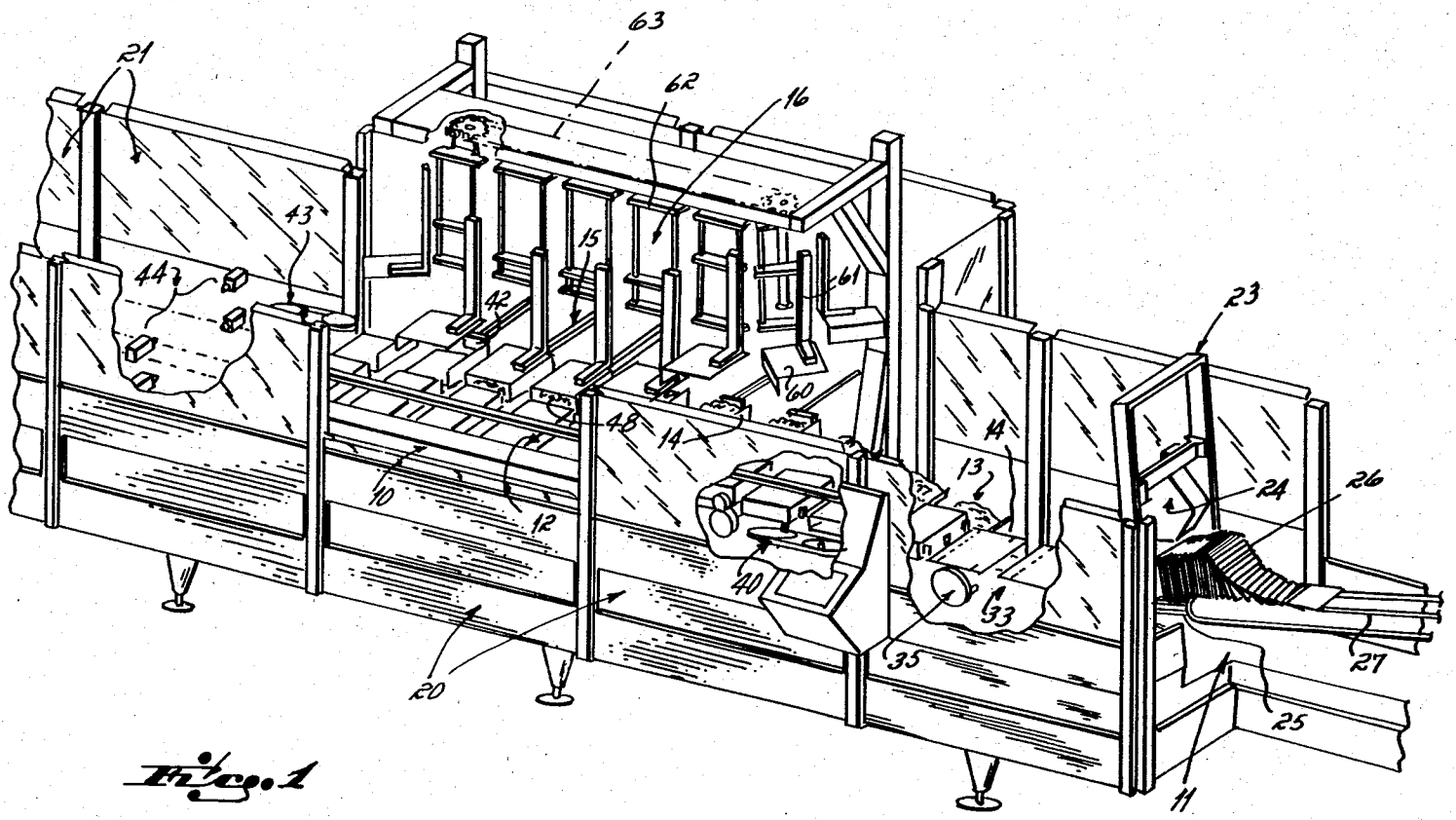
FIG. 1 is a diagrammatic perspective view of the cartoner of the present invention.

A cartoner with which the present invention is employed includes a frame 10 which supports the principal operating elements. The frame supports a carton feeder 11, a carton transport conveyor 12, a product bucket conveyor 13 and product buckets 14 mounted on the conveyor and a barrel loader 15. An overhead tamper confiner 16 is employed for products which must be compressed either vertically or horizontally or both in order to size them for introduction into the cartoner.

The cartoner is surrounded by a series of lower opaque guard panels 20 and guard windows 21 which are capable of being raised and lowered to expose the operating components of the machine for repairs, unclogging jams and the like.

In somewhat more detail, the feeder 11 has a frame 23 which supports a rotatable feed mechanism 24 of the type disclosed in the copending application of Scarpa et al Ser. No. 276,081, filed June 22, 1981 now U.S. Pat. No. 4,429,864. The feeder also includes a pair of spaced parallel downstream chains 25 on which flat folded cartons 26 are supported and gradually moved toward the rotary feeding device. The cartons 26 may be placed on upstream notched chains 27 by an operator, they may be fed onto the chains one at a time by a vertically oriented magazine, or they may be fed onto the chains 25 by an overhead conveyor which receives the cartons from a side seam gluer, not shown. The chains will be described in more detail below.

The carton transport conveyor 12 has three elongated, parallel endless chains 29. The outboard chains support trailing transport lugs 30. The center chain 31 supports a leading transport lug 32. The center chain may be shifted with respect to the outboard chains in order to vary the spacing between the leading and trailing transport lugs in order to accommodate cartons of differing lengths (the length of the carton is the dimension in the machine direction). The cartons are fed in the flat folded condition onto the transport conveyor. Prior to being captured between the leading and trailing transport lugs of the conveyor 12, the carton is transported from the feeder by a conveyor 33. During the traverse of conveyor 33, , the carton flaps are separated by a flap separator 35 which forces a lower flap downwardly into a position where it can be engaged by a stationary plough and turned and held at a 90° angle to the wall to which it is connected. The carton then moves through an air opener 36 which directs blasts of air from either side of the carton in a horizontal direction to force air between the upper and lower walls of the carton, thereby causing the carton to swing to an erect orientation between the leading and trailing lugs of the transport conveyor. That air opener is disclosed in U.S. Pat. No. 3,728,945, issued Apr. 24, 1973.

Immediately downstream of the air opener are opposed flap spreaders 40. The flap spreaders carry lugs 41 which engage the leading flap of the carton and swing it through 90° so that it can be captured by stationary rails and held in that attitude as the carton passes the barrel loader 15. The trailing flap is similarly captured by the rails and held open.

As the carton passes the barrel loader, pusher heads 42 engage products in the product buckets and thrust them across the product buckets into the opened cartons.

After the carton has been filled, it is conveyed past flap closers 43 which engage the trailing flaps and swing them to a closed position. Glue guns 44 are mounted alongside the carton conveyor downstream of the flap closers 43. The glue guns apply an appropriate pattern of glue to one of the horizontal flaps of the carton. When the glue is applied, ploughs swing the horizontal flaps to a closed position and hold them there during the brief period required for the glue to set.

Figure 3:
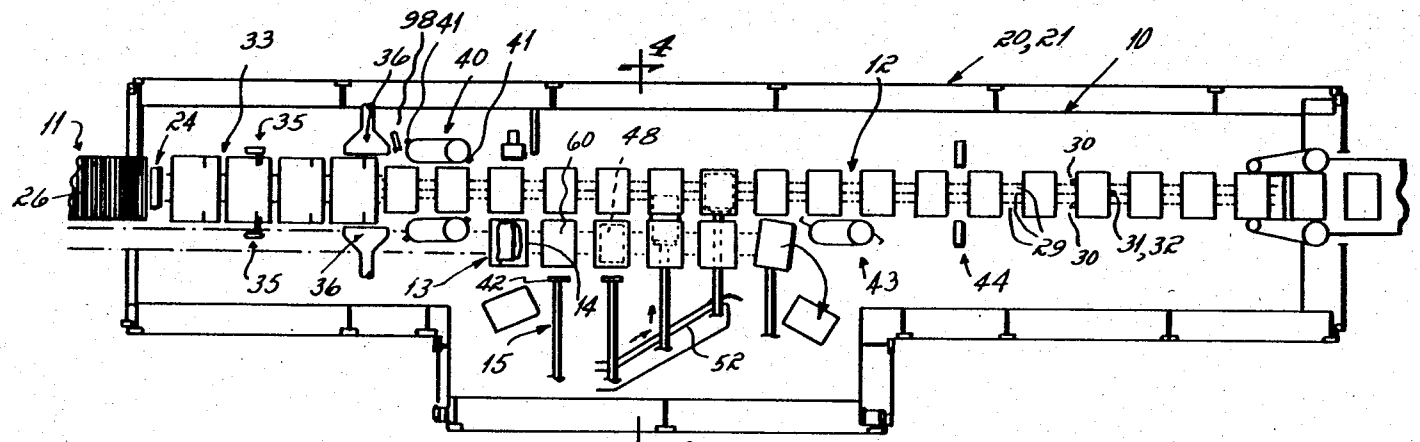
FIG. 3 is a diagrammatic top plan view of the cartoner.

The product bucket conveyor 13 consists of a pair of endless chains which support a series of spaced product buckets 14 which convey products 48 past the open cartons. The product buckets may be L-shaped as shown, or may be U-shaped depending upon the product to be filled into the carton and the need for imparting shaping to the product to enable it to conform dimensionally to the size of the carton. The barrel loader 15 diagrammatically illustrated in FIG. 3 consists of a series of pusher heads 42 which are slidably supported on endless chains. The pusher heads have cam followers which ride in a cam track 52. As the pusher heads are conveyed on the upper run of the chains which support them, the cam track 52 causes each pusher head to move across the product bucket where it engages the product 48 and thrusts it into an open carton.

In the illustrated form of the invention, the tamper confiner 16 has a series of L-shaped tamper confiner elements 60 which are carried by vertical posts 61 and supported on carriages 62. The carriages are connected to endless chains 63 mounted on horizontal sprockets, not shown, to convey the tamper confiner elements over the upper run of the product bucket conveyor adjacent the barrel loader. A cam track 64 is mounted adjacent the path of the posts 61. The posts 61 have followers which ride in the cam track to lower the tamper confiners as they pass over the product buckets and to raise them after the carton has been filled with product by the barrel loader so that they can be swung out of the way of the mechanism during their excursion around to the outside of the cartoner. The L-shaped tamper confiner elements cooperate with the L-shaped product buckets to engage the product such as a breakfast cereal pouch and to shape it into a generally rectangular cross section matching that of the interior of the carton, thereby enabling the pusher heads 42 to thrust the pouch into the cartons. If the product buckets are U-shaped, the tamper confiner may be a flat platen which simply compresses the product as, for example, facial tissues, so that vertical dimension of the product matches the dimension of the carton opening.

In the operation of the cartoner the flat folded carton blanks are fed from the feeder 24 toward the transport conveyor. The upper and lower flaps of the carton are separated so as to permit air to be introduced between the upper and lower walls of the carton. At the air opener 36, blasts of air erect the carton between the leading and trailing transport lugs. As the cartons move downstream, the horizontal flaps are plowed up and down and the vertical flaps are swung through 90° on both sides of the carton to prepare the carton for the introduction of product.

Product which has been transferred to the product buckets is confined by the overhead tamper confiner 16 as the products pass the barrel loader 15. There, the pusher heads 42 of the barrel loader drive each product across the product bucket and into the carton opposite it as the product buckets and transport conveyors move alongside each other past the barrel loader.

After the product has been loaded into the cartons, the carton flaps have a pattern of glue applied to them and are closed and held in a closed condition until the glue sets.

THE BARREL LOADER

The barrel loader 15 is mounted on the frame 10 of the cartoner. It is located adjacent to the product bucket conveyor 13 and longitudinally positioned at the area where the product buckets 14 are aligned between the leading and trailing transport lugs 32 and 30, respectively. Thus, the product 48 is normally aligned with a carton 26 so that it can be thrust by the barrel loader from the product bucket into the carton.

The product is thrust into the carton by pusher heads 42. Each pusher head includes a plate 65 mounted on a rod 66 which is cantilevered from a block 67. The block 67 is slidably mounted on a rod 68 which is supported on the upturn ends 70 of a plate 71. The plate 71 has an elongated slot in its center in which a bushing 72 depending from the block 67 rides to maintain the proper orientation of the pusher head. Projecting from the top of the block 67 is a follower 75 in the form of a roller. The roller normally rides in the cam track 52, as will be described in greater detail below. Each plate 71 is securely clamped between two endless chains 76 and 77 which carry the pusher heads in a generally ovalshaped path. The chains pass around sprockets, not shown, which are in turn driven by the main drive for the cartoner so that the barrel loader operates in synchronism with the rest of the cartoner.

Figure 6:
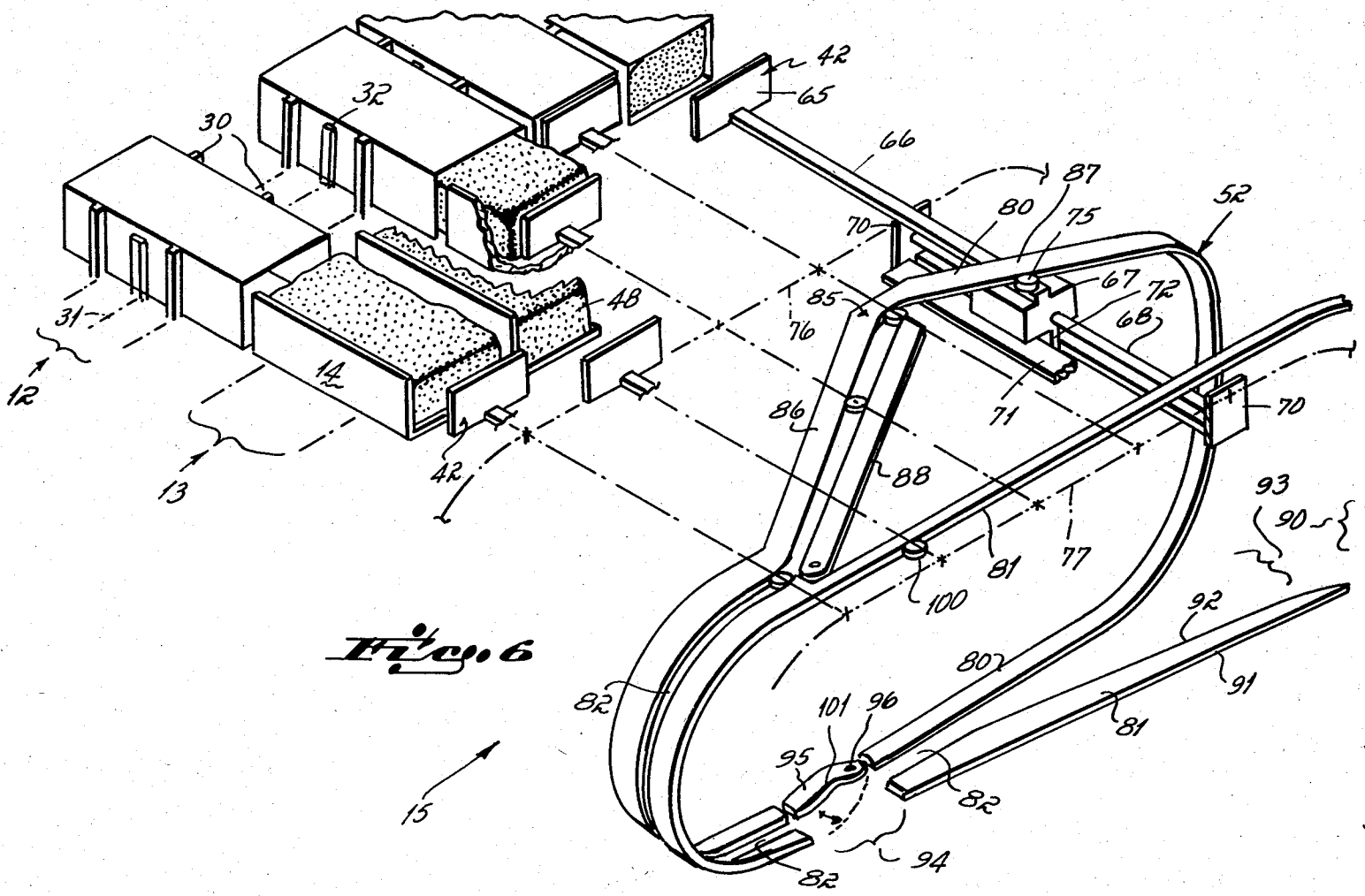
FIG. 6 is a diagrammatic perspective view of the barrel loader.

The cam track 52 is best illustrated in FIG. 6. In side elevation, it generally follows the oval path of the chains 76, 77. The cam track includes an inner rail 80 and an outer rail 81. Between the two rails, a slot 82 is formed through which the followers 75 normally pass. The inner rail has a V-shaped section 85 formed by an upstream leg 86 and a downstream leg 87 which define the path of movement of the followers 75 and hence the heads 42 as they are cammed through the product bucket to thrust the product into the carton and thereafter withdrawn. The outer rail carries a pivoted arm 88 which normally lies parallel to the upstream leg 86 of the V-shaped section 85 to define the slot through which the cam followers 75 pass. The arm 88 is provided with mechanism for swinging it away from the leg 86 into a position parallel to the outer rail 81 when a jam on the pusher head is detected.

The outer rail 81 has a discontinuity or large gap 90 at the downstream end of the barrel loader. The outer rail includes a lower section 91 which has a tapered surface 92 which creates a flared opening 93 with the lower portion of the inner rail 80. The outer rail 81 has a second gap 94 at its lower portion just before the pusher heads swing upwardly to the upper operative portion of the cam track. Adjacent that gap, the inner rail 80 has a switch or gate 95 which is pivoted at 96. The switch has two positions. The first, shown in FIGS. 5 and 6, is in alignment with the inner rail 80 and permits the pusher head followers 75 to pass from the flared opening 93 to the operative slot 82 in the cam track. In the second position, shown in FIG. 5*a*, the switch extends diagonally across the slot 82 and into the gap 94. When in that position, the cam follower for each pusher head will be thrust to the outside surface of the outer rail 81 and will not follow the normal operating path defined by the slot 82. More particularly, the pusher head will be blocked from entering the product bucket with which it is aligned.

Figure 2:
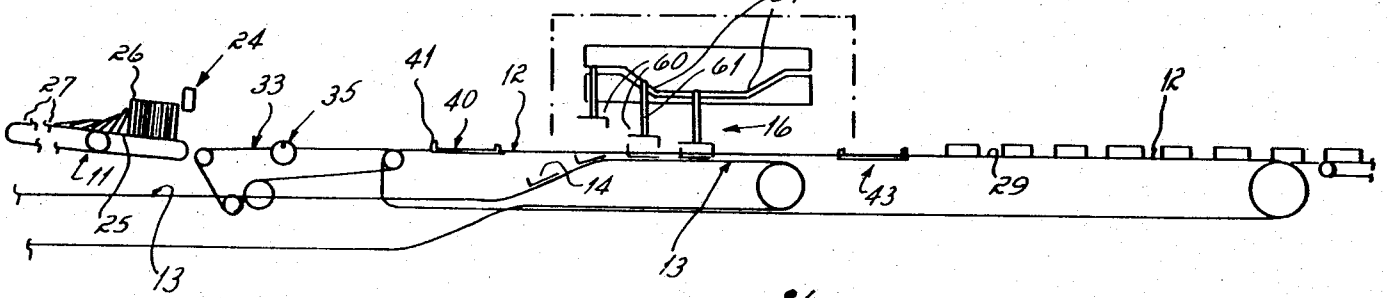
FIG. 2 is a diagrammatic side elevational view of the cartoner.

The switch 95 is shifted between the two operative positions by a double-acting piston and cylinder 97. (FIGS. 5 and 5*a*) The piston and cylinder 97 is operatively connected to a photoelectric detector 98 (FIG. 2) which detects the presence or absence of a carton in the transport conveyor.

It can be seen that the operative surface 101 of the switch 95 is preferably curved in order to make a smooth transition of the follower which engages it as the follower is cammed across the gap 94 to the outer surface of the outer rail 81.

In the operation of the invention, the tubular cartons 26 and the product 48 are conveyed past the barrel loader in alignment with each other and in alignment with respective pusher heads 42. As the product and cartons move downstream, the cam followers 75 riding in the slot 82 cam the pusher heads into the product buckets as the followers ride along the leg 86 of the V-shaped section 85. At the apex of the V-shaped section, the product has been pushed completely into the carton. The leg 87 of the V-shaped section thereafter cams the follower and hence pusher head 42 away from the filled carton and thus withdraws it from the product bucket before the product bucket reaches the end of its upper run. The follower then continues to ride around the inner rail 80 until it enters the slot 82 through the flared opening 93.

If the detector 98 senses the absence of a carton on the transport conveyor, it will trigger the operation of the switch 95 as the pusher head associated with that empty location moves toward the gate 95. The gate is swung across the slot 82, causing the follower to ride around the outer surface of the rail 81, as shown at 100. In that position, the follower is blocked from movement along the slot 82 and into the V-shaped section 85. Hence, there is no engagement of the pusher head with the product. The product will simply drop into a bin at the end of the barrel loader and the operation of the cartoner will not be otherwise affected.

As soon as the detector senses the presence of a carton as the carton conveyor continues to move, the gate 95 will be swung back to its normal operating position so that the next pusher head follower will ride in the operative slot 82.

The follower 100 riding along the outer surface of the outer rail 81 will be captured by the tapered surface 92 of the lower section of the outer rail as the follower enters the flared opening 93 so that in the next excursion, it will be guided into the operative slot 82. The large gap 90 permits the follower to make the transition from the outer surface to the inner surface of the rail 81.

Having described my invention, we claim:

1. In a cartoning machine having a transport conveyor for conveying cartons in tubular form, a product bucket conveyor for conveying product adjacent said cartons, and a barrel loader for thrusting said product from product buckets into a carton, said barrel loader having a plurality of pusher heads slidably carried between a pair of endless chains, each said endless chain traveling in a generally oval-shaped path which lies in vertical planes, a cam track disposed adjacent to said chains, said cam track, viewed in elevation, follows the oval path of said chains and has an upper section and a lower section joined by curved upstream and downstream sections, said pusher heads having followers engaging said cam track upper section to cam said heads toward said transport conveyor, a detector associated with said transport conveyor to detect the absence of a carton on said conveyor, the improvement comprising, a switch responsive to said detector and located at the lower section of said cam track to shift a pusher head out of said cam track for one revolution of said chains upon detection of the absence of a carton on said carton conveyor, said cam track further comprising, an inside continuous rail whose upper portion has a section angled toward said product bucket conveyor, an outside rail having an upper section spaced from the upper section of said inside rail to form a cam slot for said followers, said outside rail having a curved section adjacent to and spaced from the upstream end of said continuous rail, and a lower portion spaced from and adjacent to the lower section of said continuous rail, said lower section having a gap therein, an elongated switch forming part of said inside rail and having the end nearer the oncoming follower pivoted to said inside rail adjacent said gap, means for moving said switch diagonally across said cam slot to divert a follower through the gap of said outside rail, whereby the pusher head associated with said diverted follower is blocked from entering a product bucket.

2. Apparatus as in claim 1 in which said detector maintains said switch in a shifted position until said detector senses the presence of an incoming carton on said transport conveyor.

3. Apparatus as in claim 1 in which, the lower section of said outer rail, upstream of said switch, diverges away from said inner rail to form a flared opening to capture a cam follower and guide it into said cam slot adjacent said switch.

4. Apparatus as in claim 1 wherein said inner rail has a V-shaped section adjacent said product bucket conveyor, said outer rail lying substantially in a vertical plane and being discontinued at the downstream end of said V-shaped section, and an arm pivoted to said outer rail and normally lying parallel to the upstream leg of said V-shaped section to cam said pusher heads toward said product bucket conveyor.

* * * * *